US005375449A

United States Patent [19]

Bononi

[11] Patent Number: 5,375,449

[45] Date of Patent: Dec. 27, 1994

[54] METHOD FOR FORMING HOLLOW NUTDRIVERS FROM TUBING

[75] Inventor: Fred A. Bononi, Novi, Mich.

[73] Assignee: A.T. & G. Company, Inc., Farmington Hills, Mich.

[21] Appl. No.: 179,662

[22] Filed: Jan. 11, 1994

[51] Int. Cl.[5] ..... B21D 41/02

[52] U.S. Cl. ..... 72/370; 72/318; 72/356; 76/114

[58] Field of Search ..... 72/318, 306, 370, 359, 72/358, 355.6, 356; 76/114, 119

[56] References Cited

U.S. PATENT DOCUMENTS 1,467,264 9/1923 Breeze ..... 72/370
1,566,645 12/1925 Breeze ..... 72/359
2,016,795 10/1935 Belknap ..... 72/318
4,154,082 5/1979 Beech ..... 72/370
4,594,874 6/1986 Bononi et al. ..... 72/356

FOREIGN PATENT DOCUMENTS 624036 7/1961 Canada ..... 76/119

*Primary Examiner*—Daniel C. Crans
*Attorney, Agent, or Firm*—Robert G. Mentag

[57] ABSTRACT

A method of forming a number of sizes of hollow shaft nutdrivers from a common size metal tube workpiece. The method comprises three steps to form a hex drive socket on one end of a metal tube workpiece, and a fourth step to form a plurality of raised wings on the other end of the metal tube workpiece for retaining the other end of the then finished nutdriver in a handle.

3 Claims, 2 Drawing Sheets

METHOD FOR FORMING HOLLOW NUTDRIVERS FROM TUBING

BACKGROUND OF THE INVENTION

1. Field of the Invention

The field of art to which this invention pertains may be generally located in the class of devices relating to work forming processes. Class 72, Metal Deforming, United States Patent Office Classification, Subclass 356 appears to be the applicable general area of art to which the subject matter similar to this invention has been classified in the past.

2. Description of the Prior Art

This invention relates to an improved method of forming a number of sizes of hollow shaft nut drivers from a common tube size. Heretofore, it has been proposed to cold form elongated nut drivers from a tube workpiece by driving the tube workpiece into a die cavity means with a power operated punch for reducing both the inside and outside diameters of one end of the tube workpiece and along a predetermined length of the tube workpiece, so as to form a longitudinally extending shaft of reduced diametrical dimensions relative to the original diametrical dimensions of the tube workpiece. The last described prior art cold forming method is disclosed in U.S. Pat. No. 4,594,874. A disadvantage of said prior art cold forming method is that it requires a tube workpiece having a separate diameter for each nut driver size desired to be produced.

SUMMARY OF THE INVENTION

The method of this invention includes a series of steps for producing a number of different size nut drivers from a common size tube workpiece. The method of this invention reduces the number of raw material sizes of tubes that are required to manufacture nutdrivers, resulting in lower raw material inventory cost as well as processing cost. This method can be applied to produce a long length series of nutdrivers that are beyond the length capacity of cold heading equipment. An advantage of the method of the present invention is that it provides a low cost product. The method of the present invention of manufacturing nutdrivers provides a lower unit weight per each individual nutdriver, as well as a cosmetic improvement to the nutdrivers which are sold in sets. Nutdriver sets contain one of each size nutdrivers such as: 3/16ths inch, ¼ inch, 5/16ths inch, 11/32nds inch, ⅜ths inch, 7/16ths inch and ½ inch. Nutdriver sets are also available in metric size sets.

The improved method of the invention of forming hollow shaft nutdrivers from a common size tube may be carried out on high production progressive cold heading equipment, as well as by a simple multi-stage hand feed press operation. The improved method for forming nutdrivers consists of a progessive expansion of one end of a hollow tube workpiece, which is carried out in three steps. A fourth step is employed if it is desired to apply a retention means on the other end of the tube workpiece for retaining the nutdriver on a handle.

DESCRIPTION OF THE PREFERRED EMBODIMENTS

Figure 1:
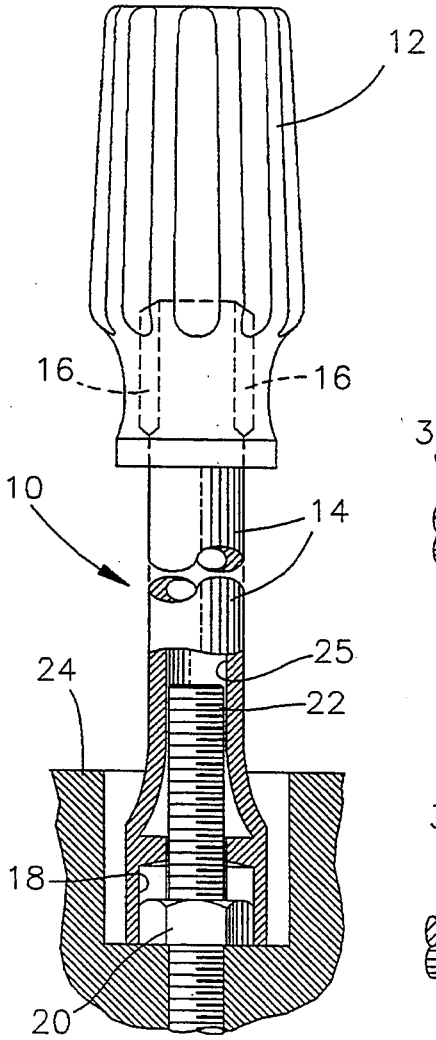
FIG. 1 is an elevation view of a typical nutdriver, and showing the nutdriver partly in section.

Referring now to the drawings and in particular to FIG. 1, the numeral 10 generally designates a conventional nutdriver which may be made in accordance with the present invention. The nutdriver 10 is illustrated as having a handle 12 which is drivingly connected to the upper end of a longitudinally extended shaft 14 of the nutdriver 10 by a pair of retention wings 16. The retention wings 16 may be made to any desired length and width, and are designed proportional to the nutdriver size in order to meet assembly torque requirements that the nutdriver 10 must withstand without having the shaft 14 rotate in the handle 12 under use conditions. Although two retention wings 16 have been illustrated in FIG. 1, it will be understood that any desired number of retention wings 16 may be employed for the purpose of drivingly attaching the upper end of the nutdriver shaft 14 to the handle 12.

A fastener driving hex socket 18 of enlarged cross section dimension is provided on the lower end of the shaft 14, opposite the handle 12, for engaging a fastener, such as the illustrated hex nut 20, mounted on the illustrated bolt 22 which is threadably secured to a base member 24. The nutdriver 10 has an axially extending through-opening 25, to provide clearance for the shank of the bolt 22 on which the nut 20 is mounted within the fastener driving hex socket 18, to permit the nut 20 to be rotated by the nutdriver 10.

Figure 2:
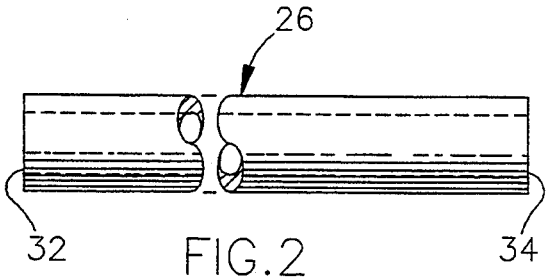
FIG. 2 is a broken, side elevation view of a hollow tube workpiece employed in the method of the present invention.

The improved method of the present invention for forming nutdrivers 10 consists of progressive expansion of one end of a hollow metal tube workpiece, generally designated by the numeral 26 in FIG. 2. The metal tube workpiece 26 is supplied in specially sized dimensions of uniform initial outside diameter and uniform initial wall thickness. The metal tube workpiece 26 is made from a standard alloy steel seamless or welded tubing, such as AISI 4130 in an annealed condition. The metal tube workpieces 26 are supplied with outside and inside diameters that are sized to produce multiple drive sizes 18 of nutdrivers, from one tube size. As shown in FIG. 2, the ends 32 and 34 of the metal tube workpiece 26 are squared in parallel planes which are normal with the major longitudinal axis of the metal tube workpiece 26.

Figure 3:
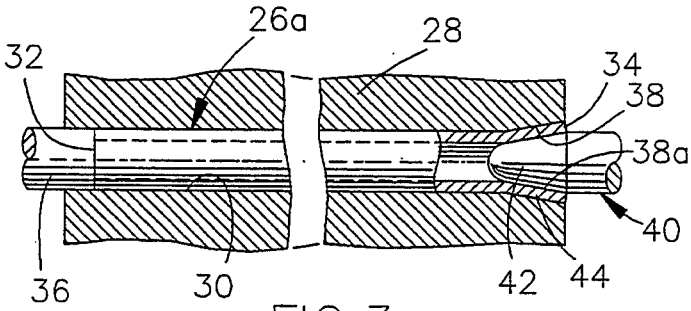
FIG. 3 is a broken, schematic representation of a first step in the method of this invention.

The first step in the method of the present invention comprises slidably mounting a tube workpiece 26 in a longitudinal cylindrical bore 30 in a first female forming die 28, as shown in FIG. 3. The metal tube workpiece is designated in FIG. 3 by the numeral 26*a* and it shows said workpiece in the form after the the first method step is completed. The rear end of the metal tube workpiece 26*a* is designated by the numeral 32 and the front end thereof is designated by the numeral 34. As shown in FIG. 3, the rear end 32 of the metal tube workpiece 26*a* seats against a knockout pin 36 which is mounted in the female die longitudinal bore 30 at the rear end of the female die 28, as viewed in FIG. 3. The front end 34 of the metal tube workpiece 26*a* is positioned in a female die cavity 38 that is formed in the front end of the longitudinal bore 30 in the female die 28. The female die cavity 38 is cone or frustoconical shaped.

The numeral 40 generally designates a forming punch which has a tapered or cone shaped forming nose 42. A ram (not shown) drives the tapered forming punch 40 into the front end 34 of an unformed metal tube workpiece 26, seating the unformed metal tube workpiece 26 in the female die 28, against the knockout pin 36, and such action sets the workpiece length. The cone shaped nose 42 on the forming punch 40 expands the material of the unformed metal tube workpiece 26, as it reaches its compressive yield point in a state of plastic flow, in the cone shaped female die cavity 38. The diameter and angle of the surface of the cone shaped nose 42 of the forming punch 40 are in direct proportion to the cone shape of the female die cavity 38. The cone shaped forming nose 42 is sized to maintain a uniform wall thickness, designated by the numeral 44, of the metal tube workpiece front end portion seated in the female die cavity 38, which is required for the subsequent forming steps. The cone shaped design of the female die cavity 38 functions to control the metal expansion of the front end portion of the unformed metal tube workpiece 26 in the female die cavity 38 when the driving force is supplied to the forming punch 40 by said ram (not shown). After the forming operation of the front end portion of the metal tube workpiece 26*a* has been carried out, as set forth hereinabove, the metal tube workpiece 26*a* is ejected from the female die 28 by the knockout pin 36, and it is transferred to the next forming station. The inner shape of the front end of the metal tube workpiece 26*a*, after the first step of the method of the present invention has been completed, is indicated in FIG. 3 by the numeral 38*a* and it is frustoconical in a shape that is complementary to the shape of the female die cavity 38.

Figure 4:
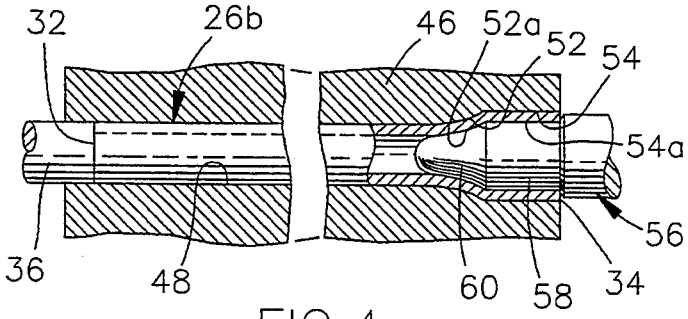
FIG. 4 is a broken, schematic representation of a second step in the method of this invention.

The second step in the method of the present invention is illustrated in FIG. 4. The numeral 46 designates the female forming die employed in the second step of said method and it is provided with a longitudinal bore 48 which receives the workpiece 26*a* from the female die 28 employed in the first step of the method of the present invention. The metal tube workpiece in FIG. 4 is designated generally by the numeral 26*b* and it shows said workpiece in the form after the second method step is completed. The rear end of the metal tube workpiece 26*b* is designated in FIG. 4 by the numeral 32 and the front end thereof is designated by the numeral 34. As shown in FIG. 4, the rear end 32 of the metal tube workpiece 26*b* seats against a knockout pin 36 which is mounted in the female longitudinal bore 48 at the rear end of the female die 46, as viewed in FIG. 4. The front end 34 of the metal tube workpiece 26*b* is positioned in a female die cavity which is formed at the front end of the longitudinal bore 48 in the die 46, and which includes an outer or entrance cylindrical section 54 and an inner frustoconical section or cone section 52. The female die cavity comprising the two sections 52 and 54 is constructed in the form of the finished outside shape of the nutdriver hex socket 18. The numeral 56 generally designates a forming punch which has a cylindrical portion 58 that is formed complementary to the cylindrical female die cavity entrance section 54. The forming punch 56 is further provided with a cone shaped nose 60 that is integral with the front or leading end of the cylindrical punch portion 58. The cone shaped punch nose 60 is complementary in shape to the inner female die cavity section 52.

A ram (not shown) drives the forming punch cylindrical portion 58 and the cone shaped nose 60 into the front or leading end 34 of a metal tube workpiece 26*a* which has been mounted in the female die 46, and such action seats the metal tube workpiece 26*a* in the female die 46 against the knockout pin 36, and it expands the material in the leading end 34 of the metal workpiece 26*a* from the conical shape 38*a* to the shape of the front end of the metal tube workpiece 26*b* shown in FIG. 4. The forming punch 56 expands the material of the metal tube workpiece front end 34 from the shape shown in FIG. 3 for the metal workpiece 26*a* to the shape shown in FIG. 4 for the front end 34 of the metal workpiece 26*b*. An internal cylindrical cavity 54*a* is thus formed in the front end 34 of the metal workpiece 26*b*, and the internal diameter of the internal cylindrical cavity 54*a* is maintained for the required diameter for broaching the hex socket drive 18 in step number 3 of the method of the present invention. The forming punch 56 also forms a frustoconical cavity 52*a* section in the front end of the metal tube workpiece 26*b* that is integral at its front end with the inner end of the cylindrical entrance cavity 54*a* and at its rear end with the front end of the shaft forming metal tube workpiece which becomes the shaft 14 of the finished nutdriver 10.

Figure 5:
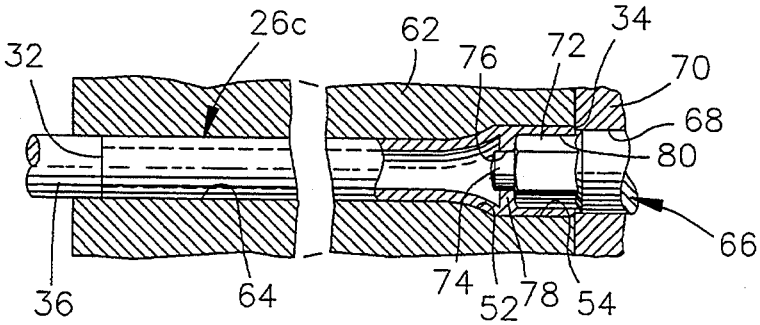
FIG. 5 if a broken, schematic representation of a third step of the method of this invention.

The third step in the method of the present invention comprises slidably mounting a metal tube workpiece 26*b*, as formed in the die 46 in FIG. 4, into the longitudinal bore 64 in a third female forming die 62, as shown in FIG. 5. The metal tube workpiece is designated in FIG. 5 by the numeral 26*c*, and it shows said workpiece in the form after the third method step is completed. In the female die 62 shown in FIG. 5, a hex socket 80 is formed in the front end 34 of the metal workpiece 26*c* by a broaching punch 66. The rear end of the metal tube workpiece 26*c* is designated by the numeral 32 and the front end thereof is designated by the numeral 34. As shown in FIG. 5, the rear end 32 of the metal tube workpiece 26*c* seats against a knockout pin 36 which is mounted in the female die longitudinal bore 64 at the rear end of the female die 62, as viewed in FIG. 5.

As shown in FIG. 5, the cylindrical body of the broaching punch 66 is slidably mounted in a bore 68 in a guide member 70, shown in fragment. The female die cavity in the front end of the die 62 is shaped identical to the female die cavity in the die 46 employed in the second step of the method, and as indicated by the numerals 52 and 54 in FIG. 4. The last mentioned female die cavity designated by the numerals 52 and 54 is identical to the outer shape of the finished part, in order to maintain product shape and size in the broaching of the hex drive socket 80 in the third step of the method of the present invention.

As shown in FIG. 5, the broaching punch 66 has a hex shape broaching head 72 carried on the front end thereof. A cylindrical pilot 74 is integrally and longitudinally positioned on the front end of the hex broaching head 72. A ram (not shown) drives the broaching punch 66 into the front end 34 of the metal workpiece **26*b* to form the hex drive socket 80, in the front end of the workpiece 26*b* to form a workpiece identified as 26*c* in FIG. 5. The hex socket 80 is the hex socket identified in FIG. 1 by the numeral 18. The broaching operation by the broaching punch 66 forms a transverse wall 78 at the inner end of the hex socket 80. An axial hole 76 is formed through the wall 78, by the cylindrical pilot 74. The pilot 74 extends through said axial hole 76 at the end of the hex socket forming operation. The cylindrical pilot 74 functions to maintain the hollow nutdrivers internal diameter during the broaching operation in the third step of the method of the present invention. At the completion of the broaching operation shown in FIG. 5, the metal workpiece 26*c* is ejected from the female die 62, and it is transferred to a forming die for forming a retention means on the rear end of the workpiece 26*c* for retaining the nutdriver shaft 14 in the handle 12, as shown in FIG. 1**.

Figure 6:
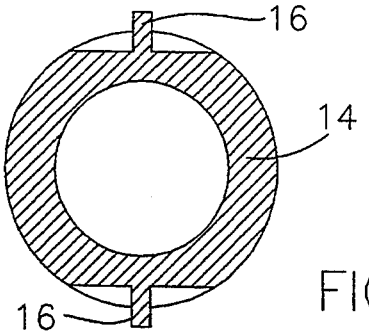
FIG. 6 is an enlarged, cross section view of the nutdriver shaft illustrated in FIG. 1, and showing a pair of radial protrusions, or raised wings formed on the nutdriver shaft for retaining the shaft in a nutdriver handle.
Figure 7:
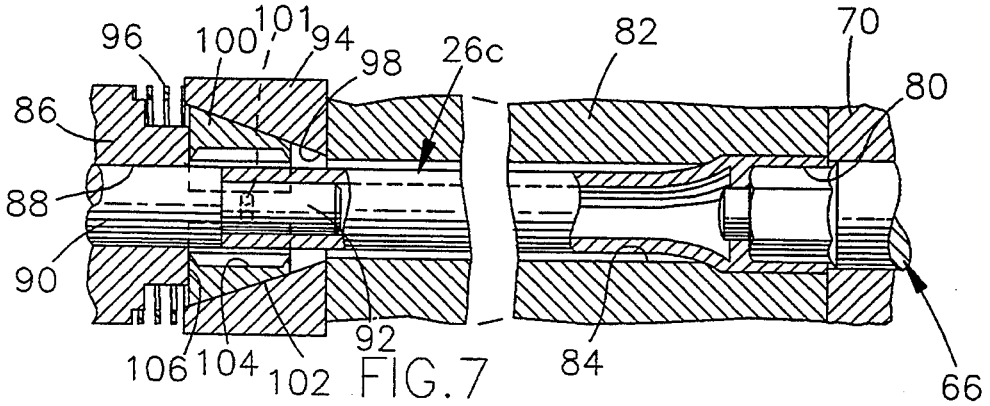
FIGS. 7 and 8 are broken, schematic representations of the step of forming the nutdriver handle retention protrusions or wings on a nutdriver shaft.
Figure 8:
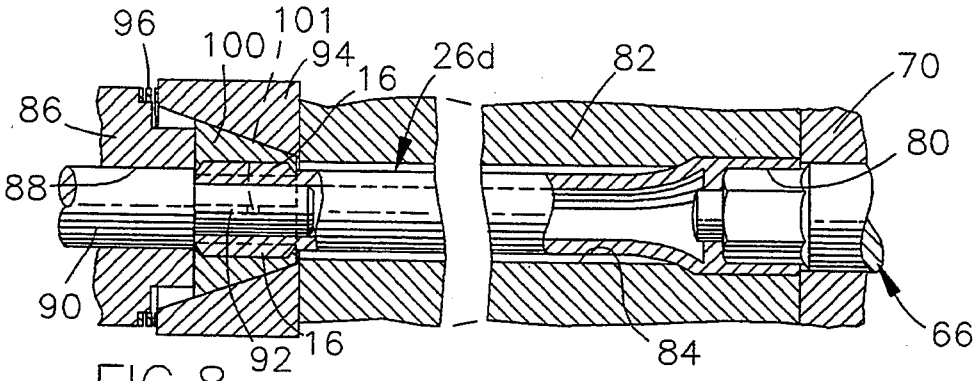

FIG. 6 is an enlarged, cross section view of the nut driver shaft 14 illustrated in FIG. 1, and showing the nutdriver shaft 14 provided with a pair of radial protrusions or raised wings 16 that are formed on the nutdriver shaft 14 for retaining it in the nutdriver handle 12. FIGS. 7 and 8 illustrate a fourth method step for forming the raised wings 16 on the nutdriver shaft 14. Although only two raised wings 16 are shown on the nutdriver shaft 14 of FIG. 6, it will be obvious that any desired plurality of raised wings 16 may be formed on the nutdriver shaft 14, as for example three raised wings 16 instead of two raised wings 16. The length and width of the raised wings 16 are made proportional to the size of the nutdriver, that is the size of the hex socket 18, in order to meet assembly torque requirements that the nutdriver 10 must withstand without the nutdriver shaft 14 rotating in the handle 12.

A slidable female die for carrying out the application of the raised wings 16 to the nutdriver shaft 14 is designated in FIGS. 6 and 7 by the numeral 82. The fourth step in the method of the present invention comprises slidably mounting a metal tube workpiece **26*c*, as formed in the die 62 of FIG. 5, in the longitudinal bore 84 in the fourth forming die 82, as shown in FIG. 7. The two raised wings 16 are formed on the metal tube workpiece 26*c* by a sliding two piece die 82 which includes a die stationery head member 86 that has a longitudinal bore 88 formed therethrough and aligned with an axial bore 84 in the die 82. Slidably mounted in the die head bore 88 is a knockout pin 90 which seats against the rear end of the metal tube workpiece 26*c*. The knockout pin 90 is provided on the front end thereof with a cylindrical pilot member 92 that is slidably mounted in the internal bore of the metal workpiece 26*c***.

A pair of diametrically, oppositely disposed winging dies 100 are slidably mounted on the transverse face 106 of the die head member 86, for transverse sliding movement thereon relative to the longitudinal axis of the metal tube workpiece **26*c*. FIG. 7 shows the two winging dies 100 biased transversely outward in opposite directions, to inoperative positions relative to the metal tube workpiece 26*c*, by suitable spring means 101. The outer peripheral surfaces 102 of the winging dies 100 are arcuately shaped in cross section, and they are slidably seated against the inner cone shaped surface 98 of a sliding tapered cone member 94. Each of the dies 100 has a flat transverse face with a longitudinal, radially outward extended, cavity 104 to form a raised wing 16. The tapered cone member 94 is biased to the right, as viewed in FIG. 7, to an inoperative position by a spring 96, which is positioned between the rear end of the tapered cone member 94 and the front end of a transverse face on the die head member 86, when the die 82 is in the retracted position shown in FIG. 7. The broaching punch 66 which is used in the third method step to form the hex socket 80 is remains in the front end of the metal tube workpiece 26*c* during the formation of the raised wings 16. In carrying out the fourth step of the invention, a ram (not shown) slides the die 82 forward from the retracted position shown in FIG. 7 to an advanced operative position shown in FIG. 8. The forward sliding movement of the die 82 applies a working force to the two winging dies 100 and they are driven transversely inward, toward each other as the tapered cone 94 slides over them. The inwardly sliding dies 100 form the pair of raised wings 16 by predetermined by shearing a predetermined length and width of the side wall of the metal tube workpiece 26*c*, at the rear end thereof, by forcing the material displaced into radial projections designated as the raised wings 16. After the formation of the raised wings 16, the ram (not shown) returns the slidable die 82 from the advanced position shown in FIG. 8 to the retracted position shown in FIG. 7, at which point the metal tube workpiece or part 26*d* is ejected from the die 82** as a finished nutdriver.

Figure 9:
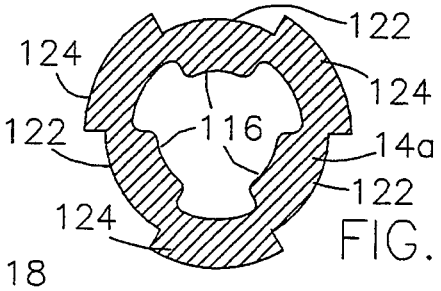
FIG. 9 is an enlarged, cross section view of the shaft of the nutdriver shown in FIG. 1, and showing a plurality of dovetail grooves formed on the nutdriver shaft for retaining the shaft in a nutdriver handle.

FIG. 9 is an enlarged, cross section view of a nutdriver shaft, as illustrated in FIG. 1, and designated by the numeral **14*a*, which is provided with an alternative gripping means for retaining the nutdriver shaft 14*a* in a handle 12. The alternative gripping means is shown as three dovetail grooves 122 which are formed on the shaft 14*a* in an alternative fourth method step carried out by the method illustrated by the structure of FIG. 10. The peripheral length and depth of the dovetail grooves 122 are made proportional to the size of the nutdriver, that is the size of the hex socket 18 in order to meet the assembly torque requirements that the nutdriver 10 must withstand without the nutdriver shaft rotating in the handle 12**.

Figure 10:
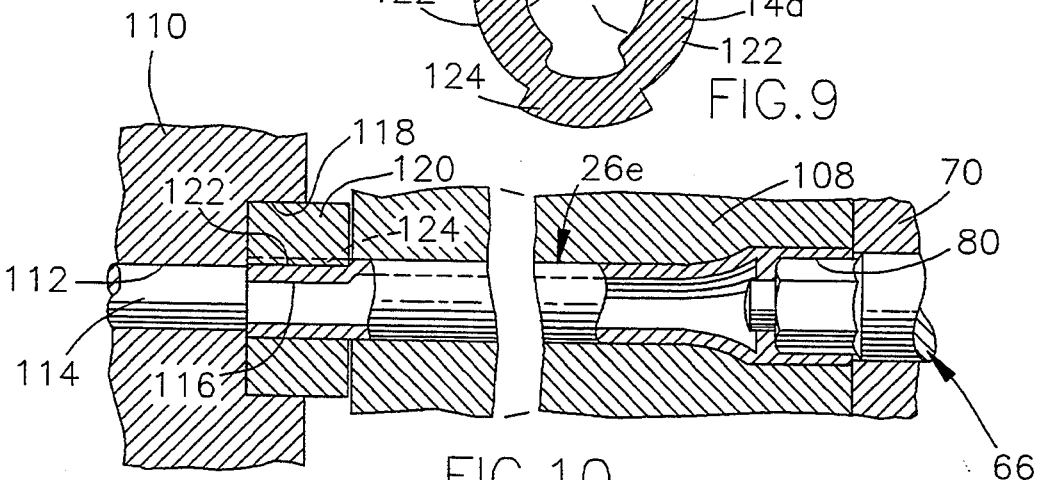
FIG. 10 is a broken, schematic representation showing the method step of the invention for applying the plurality of dovetail grooves, as shown in FIG. 9 on a nutdriver shaft.

Referring to FIG. 10, the numeral 110 designates a stationary die head having a bore 112 formed therethrough and in which is slidably mounted a knockout pin 114. The numeral 118 designates an annular recess formed in the front end of the die head 110 and in which is mounted an extrusion die 120. The numeral 108 designates a slidable female die in which is mounted a metal tube workpiece **26*c* after the third method step, illustrated in FIG. 5, of forming the hex socket 18 is completed. The broaching punch 66 which is used in the third method step to form the hex socket 80 (18) remains in the front end of the metal tube workpiece 26*c* during the formation of the dovetail grooves 122. In FIG. 10, the slidable die 108 is shown in the advanced position, driven by a ram (not shown), to force the rear end of the metal tube workpiece 26*c* through the solid carbide extrusion die 120 to form the recessed dovetail grooves 122 which are disposed between three equally spaced apart, circumerential portions 124 of the nutdriver shaft 14 and which have the original thickness of the metal tube workpiece 26*c***. The movement of the slidable die 108, from a retracted position to the advanced position shown in FIG. 10, forces the rear end of the metal tube workpiece 26c through the orifice of the extrusion die 120 to form the three circumferentially spaced apart dovetail grooves 122 and force the displaced metal radially inward into the bore in the metal tube workpiece 26c to form inward protrusions 116 opposite to the dovetail grooves 122, as shown in FIG. 9. The metal tube workpiece with the extruded dovetail grooves 122 is designated in FIG. 10 by the numeral 26e, and it is then ejected as a finished nutdriver from the slidable die 108 after the dovetail groove forming extrusion step is completed.

It will be understood that the method step of adding a retention means, as the raised wings 16 or dovetail grooves 122, may be omitted if the nutdriver is to be used without a handle, as by having the shaft 14 mounted in the chuck of a power drill or a similar tool for rotating the nutdriver. It will be understood that the method of the invention can be employed to produce a long length series of nutdrivers that are beyond the length capacity of cold heading equipment.

What is claimed is:

1. A method of forming a nutdriver from a metal tube workpiece (26) of a selected length, having a front end (34), a rear end (32), and being of uniform wall thickness, comprising the steps of:

(a) loading the metal tube workpiece (26) into a longitudinal bore (30) in a first female die (28) which has a cone shaped female die cavity (38) at a front end of said longitudinal bore (30), and which has a knockout pin (36) in the rear end of said longitudinal bore (30), the front end (34) of the metal tube workpiece (26) being positioned in said cone shaped female die cavity (38) and the rear end (32) thereof being seated on said knockout pin (36);

(b) driving a power operated forming punch (40) having a cone shaped nose (42)) into the front end (34) of the metal tube workpiece (26) to seat the metal tube workpiece against said knockout pin (36), to set the workpiece length, and expand a predetermined length of the front end of the metal tube workpiece (26) against said cone shaped female die cavity (38) to form a metal tube workpiece (26a) having a frustoconical inner shape (38a) in said predetermined length of the front end thereof while maintaining a uniform wall thickness;

(c) ejecting the metal tube workpiece (26a) from the first female die (28) and transferring it into a longitudinal bore (48) in a second female die (46), which has a female die cavity (52,54) formed in the front end of the longitudinal bore (48) that has the form of the finished outer shape of a nutdriver hex socket (18) which includes a cylindrical front entrance section (54) and an integral inner cone section (52), and with the front end of the workpiece (26a) with the frustoconical inner shape (38a) being positioned in said female die cavity cylindrical front entrance section (54) and inner cone section (52);

(d) driving a power operated forming punch (56), having a cylindrical portion (58) that has a shape complementary to the cylindrical female die cavity entrance section (54) and a cone shaped nose (60) on a leading end of the cylindrical punch portion (58), into the frustoconical leading end of the metal tube workpiece (26a) to expand the front end internal shape and form a metal tube workpiece (26b) having an internal cylindrical cavity (54a) in the front end thereof which has a diameter required for broaching a hex socket drive in a succeeding method step, and to form an internal frustoconical cavity (52a) at the inner end of the internal cylindrical cavity (54a);

(e) ejecting the metal tube workpiece (26b) from the second female die (46) and transferring it into a third female die (62) which has a female die cavity (52,54) identical to the female die cavity (52,54) in said second female die (46); and, (f) driving a power operated broaching punch (66), having a hex shaped broaching head (72) that has an integral cylindrical pilot on the front end thereof, into the internal cylindrical cavity (54a) in the metal tube workpiece (26b) to form a finished hex drive socket (80) in the metal tube workpiece (26c) .

2. A method of forming a nutdriver from a metal tube workpiece (26) of a selected length, having a front end (34), a rear end (32), and being of uniform wall thickness, comprising the steps of:

(a) loading the metal tube workpiece (26) into a longitudinal bore (30) in a first female die (28) which has a cone shaped female die cavity (38) at a front end of said longitudinal bore (30), and which has a knockout pin (36) in the rear end of said longitudinal bore (30), the front end (34) of the metal tube workpiece (26) being positioned in said cone shaped female die cavity (38) and the rear end (32) thereof being seated on said knockout pin (36);

(b) driving a power operated forming punch (40) having a cone shaped nose (42)) into the front end (34) of the metal tube workpiece (26) to seat the metal tube workpiece against said knockout pin (36), to set the workpiece length, and expand a predetermined length of the front end of the metal tube workpiece (26) against said cone shaped female die cavity (38) to form a metal tube workpiece (26a) having a frustoconical inner shape (38a) in said predetermined length of the front end thereof while maintaining a uniform wall thickness;

(c) ejecting the metal tube workpiece (26a) from the first female die (28) and transferring it into a longitudinal bore (48) in a second female die (46), which has a female die cavity (52,54) formed in the front end of the longitudinal bore (48) that has the form of the finished outer shape of a nutdriver hex socket (18) which includes a cylindrical front entrance section (54) and an integral inner cone section (52), and with the front end of the workpiece (26a) with the frustoconical inner shape (38a) being positioned in said female die cavity cylindrical front entrance section (54) and inner cone section (52);

(d) driving a power operated forming punch (56), having a cylindrical portion (58) that has a shape complementary to the cylindrical female die cavity entrance section (54) and a cone shaped nose (60) on a leading end of the cylindrical punch portion (58), into the frustoconical leading end of the metal tube workpiece (26a) to expand the front end internal shape and form a metal tube workpiece (26b) having an internal cylindrical cavity (54a) in the front end thereof which has a diameter required for broaching a hex socket drive in a succeeding method step, and to form an internal frustoconical cavity (52*a*) at the inner end of the internal cylindrical cavity (54*a*);

(e) ejecting the metal tube workpiece (26*b*) from the second female die (46) and transferring it into a third female die (62) which has a female die cavity (52,54) identical to the female die cavity (52,54) in said second female die (46); and, (f) driving a power operated broaching punch (66), having a hex shaped broaching head (72) that has an integral cylindrical pilot on the front end thereof, into the internal cylindrical cavity (54*a*) in the metal tube workpiece (26*b*) to form a finished hex drive socket (80) in the metal tube workpiece (26*c*), (g) ejecting the metal tube workpiece (26*c*) from the third female die (62) and transferring it into a slidable die (82);

(h) driving the slidable die (82) in a longitudinal direction to drive a plurality of shearing dies (100) against the periphery of the rear end (32) of the metal tube workpiece (26*c*) to form a plurality of nutdriver handle retention members thereon, which extend outwardly from the peripheral surface of the rear end (32) of the metal tube workpiece (26*c*).

3. A method of forming a nutdriver from a metal tube workpiece (26) of a selected length, having a front end (34), a rear end (32), and being of uniform wall thickness, comprising the steps of:

(a) loading the metal tube workpiece (26) into a longitudinal bore (30) in a first female die (28) which has a cone shaped female die cavity, (38) at a front end of said longitudinal bore (30), and which has a knockout pin (36) in the rear end of said longitudinal bore (30), the front end (34) of the metal tube workpiece (26) being positioned in said cone shaped female die cavity (38) and the rear end (32) thereof being seated on said knockout pin (36);

(b) driving a power operated forming punch (40) having a cone shaped nose (42)) into the front end (34) of the metal tube workpiece (26) to seat the metal tube workpiece against said knockout pin (36), to set the workpiece length, and expand a predetermined length of the front end of the metal tube workpiece (26) against said cone shaped female die cavity (38) to form a metal tube workpiece (26*a*) having a frustoconical inner shape (38*a*) in said predetermined length of the front end thereof while maintaining a uniform wall thickness;

(c) ejecting the metal tube workpiece (26*a*) from the first female die (28) and transferring it into a longitudinal bore (48) in a second female die (46), which has a female die cavity (52,54) formed in the front end of the longitudinal bore (48) that has the form of the finished outer shape of a nutdriver hex socket (18) which includes a cylindrical front entrance section (54) and an integral inner cone section (52), and with the front end of the workpiece (26*a*) with the frustoconical inner shape (38*a*) being positioned in said female die cavity cylindrical front entrance section (54) and inner cone section (52);

(d) driving a power operated forming punch (56), having a cylindrical portion (58) that has a shape complementary to the cylindrical female die cavity entrance section (54) and a cone shaped nose (60) on a leading end of the cylindrical punch portion (58), into the frustoconical leading end of the metal tube workpiece (26*a*) to expand the front end internal shape and form a metal tube workpiece (26*b*) having an internal cylindrical cavity (54*a*) in the front end thereof which has a diameter required for broaching a hex socket drive in a succeeding method step, and to form an internal frustoconical cavity (52*a*) at the inner end of the internal cylindrical cavity (54*a*);

(e) ejecting the metal tube workpiece (26*b*) from the second female die (46) and transferring it into a third female die (62) which has a female die cavity (52,54) identical to the female die cavity (52,54) in said second female die (46);

(f) driving a power operated broaching punch (66), having a hex shaped broaching head (72) that has an integral cylindrical pilot on the front end thereof, into the internal cylindrical cavity (54*a*) in the metal tube workpiece (26*b*) to form a finished hex drive socket (80) in the metal tube workpiece (26*c*);

(g) ejecting the metal tube workpiece (26*c*) from the third female die (62) and transferring it into a slidable die (82); and, (h) driving the slidable die (82) in a longitudinal direction to drive the rear end (23) of the metal tube workpiece (26*c*) through an extrusion die to form a plurality of nutdriver handle retention longitudinal grooves in the peripheral surface of the rear end (32) of the metal tube workpiece (26*c*).

* * * * *